US009820043B2

(12) United States Patent
Kanamori et al.

(10) Patent No.: US 9,820,043 B2
(45) Date of Patent: Nov. 14, 2017

(54) SOUND SOURCE DETECTION APPARATUS, METHOD FOR DETECTING SOUND SOURCE, AND PROGRAM

(71) Applicant: Panasonic Intellectual Property Corporation of America, Torrance, CA (US)

(72) Inventors: Takeo Kanamori, Osaka (JP); Kohhei Hayashida, Kyoto (JP); Shintaro Yoshikuni, Fukuoka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/430,706

(22) Filed: Feb. 13, 2017

(65) Prior Publication Data

US 2017/0251300 A1 Aug. 31, 2017

Related U.S. Application Data

(60) Provisional application No. 62/299,655, filed on Feb. 25, 2016.

(30) Foreign Application Priority Data

Nov. 10, 2016 (JP) ..... 2016-219987

(51) Int. Cl.
*H04R 3/00* (2006.01)
*G10L 25/06* (2013.01)
(Continued)

(52) U.S. Cl.
CPC ..... *H04R 3/005* (2013.01); *G10L 21/0232* (2013.01); *G10L 25/06* (2013.01); *G10L 2021/02166* (2013.01); *H04R 2430/20* (2013.01)

(58) Field of Classification Search
None
See application file for complete search history.

(56) References Cited

U.S. PATENT DOCUMENTS

2008/0130914 A1* 6/2008 Cho ..... G10L 21/0208 381/94.1
2014/0072142 A1 3/2014 Nakadai et al.
(Continued)

FOREIGN PATENT DOCUMENTS

JP 2014-056181 3/2014

*Primary Examiner* — Paul Huber
(74) *Attorney, Agent, or Firm* — Greenblum & Bernstein, P.L.C.

(57) ABSTRACT

A first correlation matrix, which corresponds to observed signals, is calculated, a non-scan range is specified, a second correlation matrix, which corresponds to an acoustic signal from a sound source within the non-scan range, is estimated, a third correlation matrix, which corresponds to a target sound source within a scan range, is calculated by removing the second correlation matrix from the first correlation matrix, and a first spatial spectrum, which is a localization result, is calculated from the third correlation matrix. In the estimation, the second correlation matrix is estimated from direction vectors calculated from a direction range of the non-scan range and a second spatial spectrum, which is a localization result calculated immediately before the first spatial spectrum is calculated.

10 Claims, 13 Drawing Sheets

(51) Int. Cl.
*G10L 21/0232* (2013.01)
*G10L 21/0216* (2013.01)

(56) References Cited

U.S. PATENT DOCUMENTS

| | | | | |
|---|---|---|---|---|
| 2014/0286497 | A1* | 9/2014 | Thyssen | H04R 3/005 381/66 |
| 2016/0044411 | A1* | 2/2016 | Tawada | H04R 3/005 381/92 |
| 2016/0055850 | A1* | 2/2016 | Nakadai | G10L 15/32 704/235 |
| 2016/0203828 | A1* | 7/2016 | Gomez | G10L 15/20 704/226 |

* cited by examiner

SOUND SOURCE DETECTION APPARATUS, METHOD FOR DETECTING SOUND SOURCE, AND PROGRAM

BACKGROUND

1. Technical Field

The present disclosure relates to a sound source detection apparatus, a method for detecting a sound source, and a program.

2. Description of the Related Art

In Japanese Unexamined Patent Application Publication No. 2014-56181, for example, a sound source direction estimation apparatus capable of accurately estimating a direction of a sound source on the basis of a plurality of acoustic signals obtained by a plurality of microphone units is disclosed. In Japanese Unexamined Patent Application Publication No. 2014-56181, a direction of a sound source is accurately estimated on the basis of a plurality of acoustic signals while taking measures against noise using a correlation matrix corresponding to noise signals based on the plurality of acoustic signals.

SUMMARY

In Japanese Unexamined Patent Application Publication No. 2014-56181, a correlation matrix corresponding to noise signals is calculated on the basis of a plurality of acoustic signals, which are observed signals, obtained by the plurality of microphone units. If there are a noise source and a sound source to be detected, or if noise is larger than sound emitted from a sound source to be detected, therefore, it is difficult to accurately calculate a correlation matrix corresponding only to a noise component. That is, with a method for detecting a sound source on the basis of signal phase differences between a plurality of acoustic signals obtained by a plurality of microphone units, if a sound pressure level of noise is higher than that of sound emitted from a sound source to be detected, it is difficult to detect the sound source to be detected due to the noise.

One non-limiting and exemplary embodiment provides a sound source detection apparatus capable of more certainly detecting a direction of a sound source to be detected within a scan range.

In one general aspect, the techniques disclosed here feature an apparatus including one or more memories and circuity that, in operation, performs operations including calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result. In the estimating, the second correlation matrix is estimated on the basis of direction vectors obtained from the direction range of the non-scan range and a second spatial spectrum, which is a localization result immediately before the first spatial spectrum is calculated.

According to the present disclosure, a sound source detection apparatus and the like capable of more certainly detecting a direction of a sound source to be detected within a scan range can be achieved.

It should be noted that general or specific embodiments may be implemented as a system, a method, an integrated circuit, a computer program, a computer-readable recording medium such as a compact disc read-only memory (CD-ROM), or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
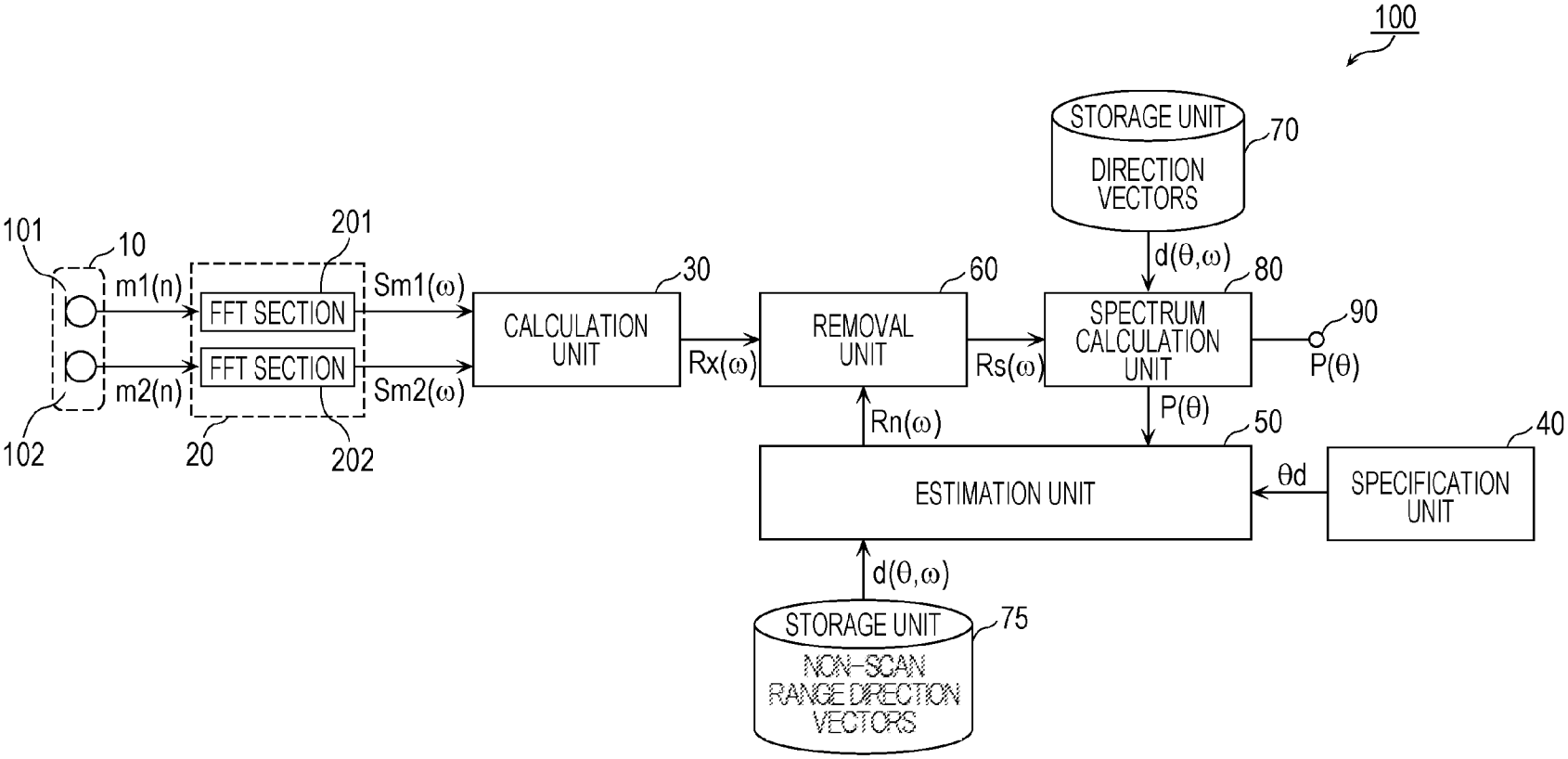
FIG. 1 is a diagram illustrating an example of the configuration of a sound source detection apparatus according to a first embodiment.

An apparatus according to an aspect of the present disclosure is an apparatus including one or more memories and circuitry that, in operation, performs operations including calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result. In the estimating, the second correlation matrix is estimated on the basis of direction vectors obtained from the direction range of the non-scan range and a second spatial spectrum, which is a localization result immediately before the first spatial spectrum is calculated.

Here, for example, the estimating may include extracting angle information, which indicates a lowest intensity direction and a highest intensity direction of the second spatial spectrum within the non-scan range on the basis of the direction range of the non-scan range and the second spatial spectrum, calculating, as a correlation matrix update amount, a correlation matrix corresponding to the second spatial spectrum in the lowest intensity direction and the highest intensity direction on the basis of the angle information and the direction vectors, and updating a fourth correlation matrix using the correlation matrix update amount to estimate the second correlation matrix, the fourth correlation matrix being a correlation matrix that is estimated before the second correlation matrix is estimated and that corresponds to an acoustic signal from a sound source within the non-scan range.

In addition, for example, in the updating, the second correlation matrix may be estimated by adding the correlation matrix update amount to the fourth correlation matrix.

In addition, for example, in the calculating the first spatial spectrum, the first spatial spectrum may be calculated on the basis of the third correlation matrix and the direction vectors.

An apparatus according to another aspect of the present disclosure is an apparatus including circuitry that, in operation, performs operations including calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, using the first correlation matrix at a time when a spatial spectrum intensity corresponding to the acoustic signal from the sound source within the non-scan range is higher than a threshold and there is no acoustic signal from the target sound source within a scan range, which indicates a direction range within which the target sound source is to be detected, calculating a third correlation matrix, which corresponds to the target sound source within the scan range, by removing the second correlation matrix from the first correlation matrix, and calculating a first spatial spectrum on the basis of the third correlation matrix as a localization result.

Here, for example, the operations may further include detecting a direction in which a noise source, which is a sound source that interferes with detection of a direction of the target sound source, exists in the second spatial spectrum as a candidate for the non-scan range.

In addition, for example, in the specifying, a user may add or remove a non-scan range.

In addition, for example, the operations may further include outputting frequency spectrum signals, which are obtained by transforming the acoustic signals obtained by the two or more microphone units into frequency domain signals and calculating, in the calculating the first correlation matrix, the first correlation matrix on the basis of the frequency spectrum signals.

A method according to another aspect of the present disclosure is a method including calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result. In the estimating, the second correlation matrix is estimated on the basis of direction vectors obtained from the direction range of the non-scan range and a second spatial spectrum, which is a localization result immediately before the first spatial spectrum is calculated.

A non-transitory computer-readable recording medium according to another aspect of the present disclosure is a non-transitory computer-readable recording medium storing a program, that, when executed by a computer, causes the computer to implement a method including calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result. In the estimating, the second correlation matrix is estimated on the basis of direction vectors obtained from the direction range of the non-scan range and a second spatial spectrum, which is a localization result immediately before the first spatial spectrum is calculated.

It should be noted that some of these specific aspects may be implemented as a system, a method, an integrated circuit, a computer program, a computer-readable recording medium such as a compact disc read-only memory (CD-ROM), or any selective combination thereof.

A sound source detection apparatus according to an aspect of the present disclosure will be specifically described hereinafter with reference to the drawings. The following embodiments are specific examples of the present disclosure. Values, shapes, materials, components, positions at which the components are arranged, and the like in the following embodiments are examples, and do not limit the present disclosure. Among the components described in the following embodiments, ones not described in the independent claims, which define broadest concepts, will be described as arbitrary components. The embodiments may be combined with each other.

First Embodiment

Configuration of Sound Source Detection Apparatus 100

FIG. 1 is a diagram illustrating an example of the configuration of a sound source detection apparatus 100 according to a first embodiment.

The sound source detection apparatus 100 detects a direction of a sound source to be detected (hereinafter also referred to as a "target sound source"). In the present embodiment, as illustrated in FIG. 1, the sound source detection apparatus 100 includes a microphone array 10, a frequency analysis unit 20, a calculation unit 30, a specification unit 40, an estimation unit 50, a removal unit 60, storage units 70 and 75, a spectrum calculation unit 80, and an output unit 90. The components will be described hereinafter.

Microphone Array 10

The microphone array 10 includes two or more separately arranged microphone units. The microphone array 10 collects, that is, observes, sound waves coming from all directions, converts the sound waves into electrical signals, and outputs acoustic signals. In the present embodiment, the microphone array 10 includes a minimal number of microphones, that is, two microphones. Microphone units 101 and 102 are non-directional microphone devices sensitive to sound pressure, for example, and separately arranged at different positions. Here, the microphone unit 101 outputs an acoustic signal m1($n$), which is a time domain signal obtained by converting collected sound waves into an electrical signal, and the microphone unit 102 outputs an acoustic signal m2($n$), which is a time domain signal obtained by converting collected sound waves into an electrical signal.

The microphone units 101 and 102 may be, for example, sound sensors or capacitive microphone chips fabricated using a semiconductor fabrication technique, instead. A microphone chip includes a vibration plate that vibrates differently in accordance with sound pressure and has a function of converting a sound signal into an electrical signal.

Frequency Analysis Unit 20

The frequency analysis unit 20 outputs frequency spectrum signals, which are obtained by transforming acoustic signals obtained by the two or more microphone units into frequency domain signals. More specifically, the frequency analysis unit 20 conducts frequency analyses on acoustic signals input from the microphone array 10 and outputs frequency spectrum signals, which are frequency domain signals. In the frequency analyses, a method for transforming a time signal into amplitude information and phase information for each frequency component, such as a fast Fourier transform (FFT) or a discrete Fourier transform (DFT), may be used.

In the present embodiment, the frequency analysis unit 20 includes FFT sections 201 and 202 that perform an FFT. The FFT section 201 receives the acoustic signal m1($n$) output from the microphone unit 101 and outputs a frequency spectrum signal Sm1(ω), which is obtained by transforming the acoustic signal m1($n$) from a time domain to a frequency domain through an FFT. The FFT section 202 receives the acoustic signal m2($n$) output from the microphone unit 102 and outputs a frequency spectrum signal Sm2(ω), which is obtained by transforming the acoustic signal m2($n$) from the time domain to the frequency domain through an FFT.

Calculation Unit 30

The calculation unit 30 calculates a first correlation matrix, which is a correlation matrix corresponding to observed signals, which are acoustic signals obtained by the microphone array 10. The calculation unit 30 calculates, as the first correlation matrix, a time average of correlation matrices between two or more acoustic signals obtained by the microphone array 10.

In the present embodiment, the calculation unit 30 calculates a first correlation matrix Rx(ω) from frequency spectrum signals output from the frequency analysis unit 20. More specifically, the calculation unit 30 calculates, as the first correlation matrix, a correlation matrix Rx(ω) on the basis of the frequency spectrum signal Sm1(ω) from the FFT section 201 and the frequency spectrum signal Sm2(ω) from the FFT section 202 using the following expressions (1) and (2).

Here, each element of the correlation matrix Rx(ω) stores phase difference information regarding a plurality of sound waves in an actual environment detected by the microphone units 101 and 102. $X_{11}$ denotes phase difference information regarding sound waves detected by the microphone units 101 and 102, for example, and $X_{21}$ denotes phase difference information regarding sound waves detected by the microphone units 102 and 101. In addition, ε{•} indicates that the matrix is a time average.

$$Rx(\omega) = \varepsilon\left\{\begin{bmatrix} x_{11}(\omega) & x_{12}(\omega) \\ x_{21}(\omega) & x_{22}(\omega) \end{bmatrix}\right\} \tag{1}$$

$$x_{ij}(\omega) = \frac{Sm_i(\omega)Sm_j(\omega)^*}{|Sm_j(\omega)||Sm_j(\omega)|} \tag{2}$$

When sound pressure sensitivity characteristics of the microphone units (the microphone units 101 and 102 in the present embodiment) are substantially the same and uniform, a normalization term as a denominator in the expression (2) may be omitted from each element of the correlation matrix Rx(ω) as in expression (3).

$$x_{ij}(co)=Sm_i(\omega)Sm_j(\omega)^* \tag{3}$$

Specification Unit 40

The specification unit 40 specifies a non-scan range, which is a direction range θd, in which the sound source detection apparatus 100 is not to detect a target sound source. Here, θd denotes an angular range.

In the present embodiment, the specification unit 40 specifies angular ranges θ1 and θ2, for example, illustrated in FIG. 2 and excludes, from a scan range, direction ranges in which sources of noise (hereinafter referred to as "noise sources") that interferes with detection of a target sound source exist as non-scan ranges.

Figure 2:
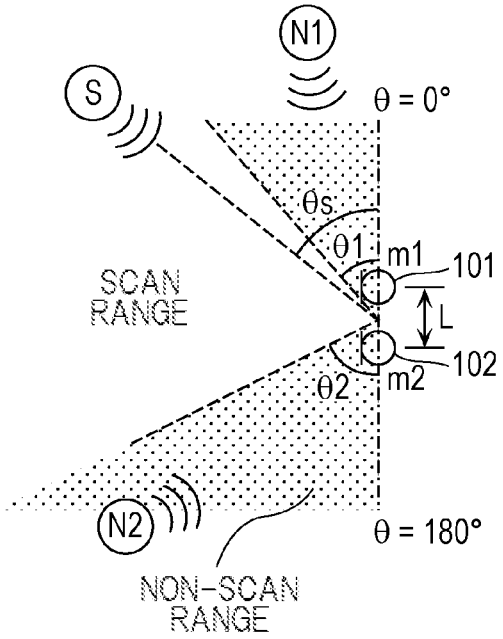
FIG. 2 is a diagram illustrating a scan range and non-scan ranges according to the first embodiment.

FIG. 2 is a diagram illustrating a scan range and non-scan ranges according to the first embodiment. FIG. 2 illustrates, as examples, a target sound source S and noise sources N1 and N2, which are sources of noise whose sound pressure levels are higher than that of sound emitted from the target sound source S. FIG. 2 also illustrates a positional relationship between the microphone array 10 (that is, the microphone units 101 and 102), the target sound source S, the noise sources N1 and N2, which are sources of noise whose sound pressure levels are higher than that of the sound emitted from the target sound source S, the scan range, and the non-scan ranges.

As illustrated in FIG. 2, the microphone units 101 and 102 are arranged at different positions. In FIG. 2, if a line connecting the two microphone units (that is, the microphone units 101 and 102) is indicated as $\theta=0°$, the target sound source S is located at $\theta=\theta s$ relative to the microphone unit 101. The noise source N1 is located in a direction range $\theta=0°$ to $\theta 1$ relative to the microphone array 10, and the noise source N2 is located in a direction range $\theta=(180°-\theta 2)$ to 180° relative to the microphone array 10.

Removal Unit 60

The removal unit 60 removes a second correlation matrix $Rn(\omega)$ estimated by the estimation unit 50 from the first correlation matrix $Rx(\omega)$ calculated by the calculation unit 30. As a result, the removal unit 60 obtains a third correlation matrix $Rs(\omega)$, which corresponds to a target sound source included in a scan range, which is a direction range within which the sound source detection apparatus 100 is to detect a target sound source. That is, the removal unit 60 calculates the third correlation matrix $Rs(\omega)$ corresponding to the target sound source by removing $Rn(\omega)$, which is the second correlation matrix corresponding to non-scan ranges, from $Rx(\omega)$, which is the first correlation matrix corresponding to observed signals.

In the present embodiment, the removal unit 60 receives the first correlation matrix $Rx(\omega)$, which corresponds to observed signals, calculated by the calculation unit 30 and the second correlation matrix $Rn(\omega)$, which corresponds to the sound sources within the non-scan ranges, that is, the noise sources, estimated by the estimation unit 50. The removal unit 60 calculates the third correlation matrix $Rs(\omega)$, which corresponds to the target sound source within the scan range, on the basis of these matrices using the following expression (4).

$$Rs(\omega)=Rx(\omega)-\gamma\cdot Rn(\omega) \tag{4}$$

In expression (4), $\gamma$ denotes a subtraction weighting. In the present embodiment, the second correlation matrix $Rn(\omega)$ does not have an error, and $\gamma$ is 1. If the second correlation matrix $Rn(\omega)$ has an error, however, $\gamma$ is adjusted as necessary to, say, 0.8.

Storage Unit 70

The storage unit 70 includes a memory or the like and stores direction vectors $d(\theta, \omega)$ indicating directions of a scan range.

In the present embodiment, the storage unit 70 stores 600 direction vectors, for example, in a range of $0°\leq\theta\leq 180°$. The direction vectors $d(\theta, \omega)$ are theoretically calculated on the basis of the relationship illustrated in FIG. 2 using expression (5). The direction vectors $d(\theta, \omega)$ are a phase difference relationship, that is, phase difference information, between the two microphone units (that is, the microphone units 101 and 102) relative to a sound source direction $\theta$. In expression (5), L denotes a distance between the microphone units, and c denotes the speed of sound. Although expression (5) defines direction vectors for two microphone units, direction vectors for three or more microphone units can be defined from a positional relationship between the microphone units.

$$d(\theta, \omega) = \left[\exp\left(j\omega\frac{L\cdot\cos\theta}{2\cdot c}\right)\exp\left(-j\omega\frac{L\cdot\cos\theta}{2\cdot c}\right)\right] \tag{5}$$

Spectrum Calculation Unit 80

The spectrum calculation unit 80 calculates a first spatial spectrum $P(\theta)$ from the third correlation matrix $Rs(\omega)$ calculated by the removal unit 60 as a result of detection of a sound source performed by the sound source detection apparatus 100, that is, as a localization result.

In the present embodiment, the spectrum calculation unit 80 calculates the first spatial spectrum $P(\theta)$ from the third correlation matrix $Rs(\omega)$ calculated by the removal unit 60 and the direction vectors $d(\theta, \omega)$ obtained from a direction range indicated by a scan range. That is, the spectrum calculation unit 80 calculates the first spatial spectrum $P(\theta)$, which indicates intensity in each direction, from the direction vectors $d(\theta, \omega)$ stored in the storage unit 70 and the third correlation matrix $Rs(\omega)$ calculated by the removal unit 60.

More specifically, the spectrum calculation unit 80 calculates, that is, obtains, the first spatial spectrum $P(\theta)$ on the basis of the third correlation matrix $Rs(\omega)$, which corresponds to a scan range, output from the removal unit 60 and the direction vectors $d(\theta, \omega)$ stored in the storage unit 70 using the following expression (6).

$$P(\theta) = \sum_{\omega} d(\theta, \omega)\cdot Rs(\omega)\cdot d^{H}(\theta, \omega) \tag{6}$$

The direction vectors $d(\theta, \omega)$ are as described above, and description thereof is omitted.

Output Unit 90

Figure 3:
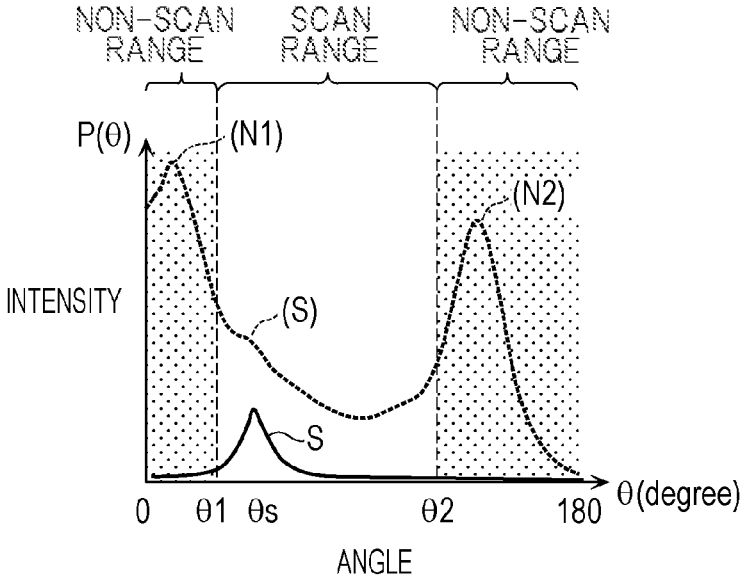
FIG. 3 is a diagram illustrating a spatial spectrum as an example of an output of a spectrum calculation unit according to the first embodiment.

FIG. 3 is a diagram illustrating a spatial spectrum as an example of an output of the spectrum calculation unit 80 according to the first embodiment. In FIG. 3, a horizontal axis represents angle, and a vertical axis represents intensity.

The output unit 90 is an output terminal, for example, and outputs a spatial spectrum calculated by the spectrum calculation unit 80 to an external device such as a display as a localization result.

In the present embodiment, the output unit 90 outputs a spatial spectrum $P(\theta)$ indicated by a solid curve in FIG. 3, for example, in which a highest intensity is observed at the angle $\theta s$, which is the direction of the target sound source S, to a display device such as an external display connected to the sound source detection apparatus 100 as a localization result.

The reason why the output unit 90 can output the localization result illustrated in FIG. 3 is that the removal unit 60 is capable of calculating the third correlation matrix, which corresponds only to the target sound source within the scan range. More specifically, the specification unit 40 limits the detection of the direction of the target sound source S to a scan range $\theta 1$ to $\theta 2$ by specifying the non-scan ranges as illustrated in FIG. 2. The removal unit 60 then calculates the third correlation matrix, which corresponds to the target sound source within the scan range, by removing a noise component, that is, by subtracting the second correlation matrix, which corresponds to the noise sources N1 and N2 within the non-scan ranges, from the first correlation matrix, which corresponds to observed signals, including components of the sound sources in all directions.

Storage Unit 75

The storage unit 75 includes a memory or the like and stores direction vectors $d(\theta, \omega)$ indicating directions of non-scan ranges.

In the present embodiment, the storage unit 75 stores 300 direction vectors, for example, in ranges of $0°\leq\theta\leq\theta 1$ and $\theta 2\leq\theta\leq 180°$. As in the above case, the direction vectors $d(\theta, \omega)$ are theoretically calculated on the basis of the relationship illustrated in FIG. 2 using expression (5). The direction vectors $d(\theta, \omega)$ are a phase difference relationship, that is, phase difference information, between the two microphone units (that is, the microphone units 101 and 102) relative to the direction $\theta$.

Although the storage units 70 and 75 are different components in FIG. 1, the storage units 70 and 75 may be a single component, instead. In this case, the estimation unit 50 and the spectrum calculation unit 80 may obtain necessary direction vectors as necessary and perform the calculations.

Estimation Unit 50

Figure 4:
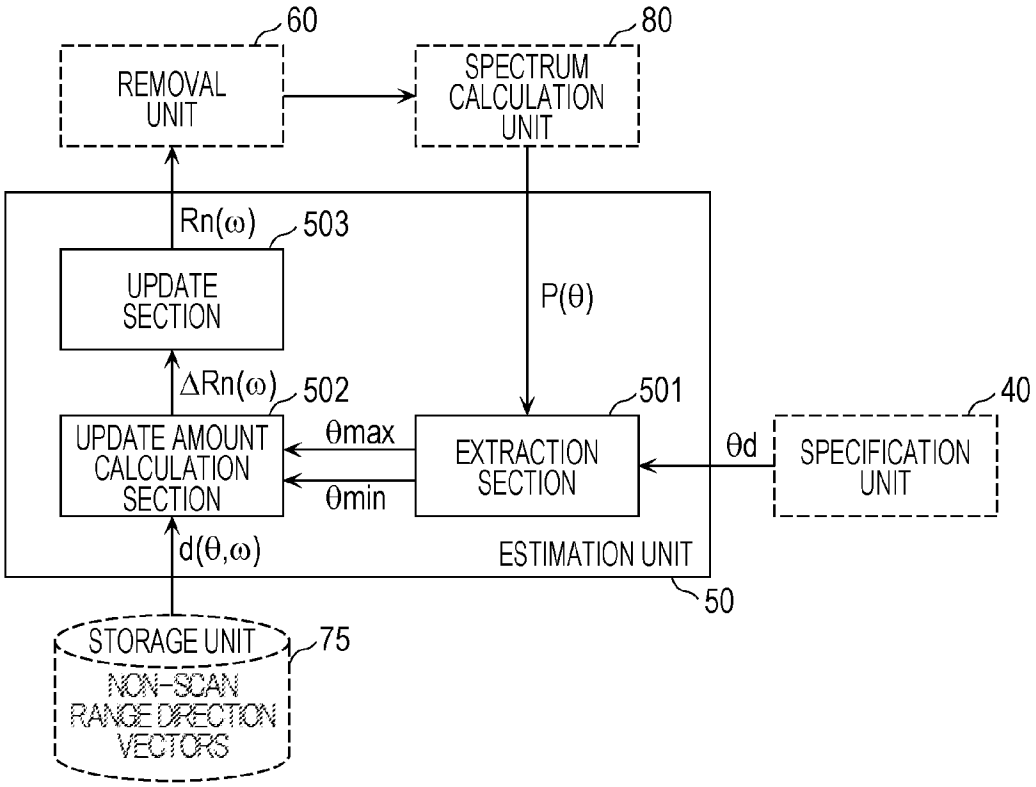
FIG. 4 is a diagram illustrating an example of a detailed configuration of an estimation unit according to the first embodiment.

FIG. 4 is a diagram illustrating an example of a detailed configuration of the estimation unit 50 according to the first embodiment.

The estimation unit 50 sequentially estimates the second correlation matrix Rn(ω), which corresponds to sound sources (that is, noise sources) within non-scan ranges. More specifically, the estimation unit 50 estimates the second correlation matrix Rn(ω), which corresponds to acoustic signals from sound sources (that is, noise sources) within non-scan ranges specified by the specification unit 40. The estimation unit 50 estimates the second correlation matrix Rn(ω) from direction vectors obtained from direction ranges of non-scan ranges specified by the specification unit 40 and a second spatial spectrum P(θ), which is calculated, as a result of detection, by the spectrum calculation unit 80 immediately before the first spatial spectrum P(θ) is calculated.

In the present embodiment, as illustrated in FIG. 4, the estimation unit 50 includes an extraction section 501, an update amount calculation section 502, and an update section 503 and sequentially estimates the second correlation matrix Rn(ω), which corresponds to noise sources.

Extraction Section 501

The extraction section 501 extracts angle information indicating a lowest intensity direction and a highest intensity direction of the second spatial spectrum P(θ) within non-scan ranges from direction ranges indicated by non-scan ranges specified by the specification unit 40 and the second spatial spectrum P(θ) calculated by the spectrum calculation unit 80.

In other words, the extraction section 501 receives the angular ranges θd indicating directions of non-scan ranges, such as $0° \leq \theta d \leq \theta 1$ and $\theta 2 \leq \theta d \leq 180°$, specified by the specification unit 40 and the second spatial spectrum P(θ), which is a localization result, calculated by the spectrum calculation unit 80. The extraction section 501 then extracts the highest intensity direction, that is, a sound source direction θmax, and the lowest intensity direction, that is, a sound source direction θmin, of the second spatial spectrum P(θ) within the non-scan ranges.

Figure 5:
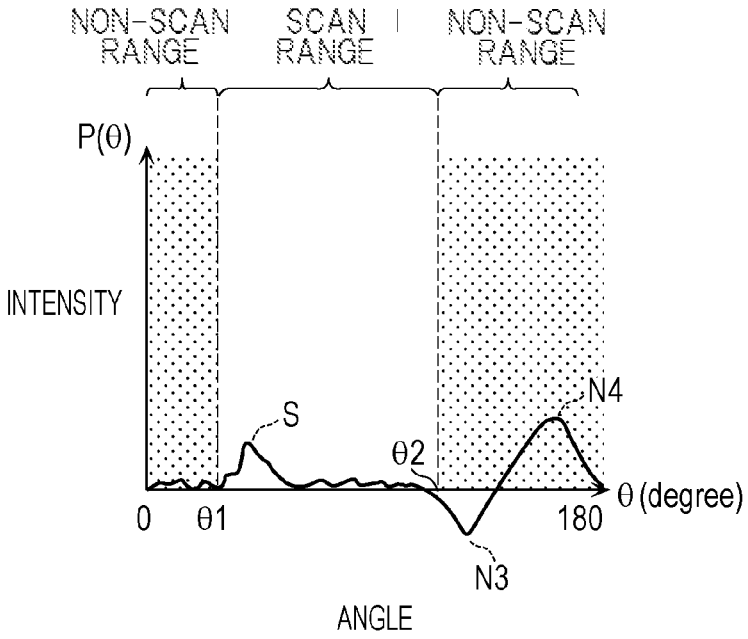
FIG. 5 is a diagram illustrating an example of a second spatial spectrum calculated and output by the spectrum calculation unit according to the first embodiment.

Here, an example of the highest intensity sound source direction θmax and the lowest intensity sound source direction θmin of the second spatial spectrum within the non-scan ranges will be described with reference to FIG. 5. FIG. 5 is a diagram illustrating an example of the second spatial spectrum calculated and output by the spectrum calculation unit 80 according to the first embodiment.

In the example of the second spatial spectrum illustrated in FIG. 5, a peak (indicated by N4 in FIG. 5) and a dip (indicated by N3 in FIG. 5) appear in the non-scan range of θ to 180°. This is because whereas the first correlation matrix Rx(ω) has been calculated by the calculation unit 30 using current observed signals, the second correlation matrix Rn(ω) has been estimated by the estimation unit 50 using the second spatial spectrum, which is a spatial spectrum in the past. That is, if noise sources included in current observed signals and noise sources included in observed signals at a time when the second spatial spectrum has been calculated, that is, observed signals subjected to a previous calculation, do not match, effects of noise are observed as well as those of the target sound source S. In the second spatial spectrum illustrated in FIG. 5, a new noise source has appeared in a direction of the peak of intensity (indicated by N4 in FIG. 5), and effects of the noise source have not been removed with the second correlation matrix Rn(ω). On the other hand, in a direction of the dip of intensity (indicated by N3 in FIG. 5), a noise source that was there no longer exists, and effects of the noise source have been removed, that is, canceled, too much with the second correlation matrix Rn(ω).

In other words, the highest intensity sound source direction θmax within the non-scan ranges is a direction of a noise source whose noise exhibits a highest sound pressure level and a direction in which the amount of cancellation (that is, the second correlation matrix Rn(ω)) is to be increased. On the other hand, the lowest intensity sound source direction θmin within the non-scan ranges is a direction in which the amount of cancellation (that is, the second correlation matrix Rn(ω)) of noise is too large and to be decreased.

The extraction section 501 thus extracts and outputs the highest intensity sound source direction θmax and the lowest intensity sound source direction θmin of the second spatial spectrum P(θ) within the angular ranges θd indicating the non-scan ranges specified by the specification unit 40.

Update Amount Calculation Section 502

The update amount calculation section 502 calculates, as a correlation matrix update amount ΔRn(ω), a correlation matrix corresponding to the lowest intensity direction and the maximum intensity direction of the second spatial spectrum from angle information θd extracted by the extraction section 501 and direction vectors d(θ,ω) obtained from direction ranges indicated by non-scan ranges.

In other words, the update amount calculation section 502 obtains or receives, from the extraction section 501, the highest intensity sound source direction θmax and the lowest intensity sound source direction θmin of the second spatial spectrum within non-scan ranges and direction vectors d(θ,ω) indicating directions of the non-scan ranges. The update amount calculation section 502 then calculates, on the basis of these pieces of information, theoretical values of a correlation matrix corresponding to the highest intensity sound source direction θmax and the lowest intensity sound source direction θmin of the second spatial spectrum and outputs the theoretical values to the update section 503 as the correlation matrix update amount ΔRn(ω). More specifically, the update amount calculation section 502 calculates the correlation matrix update amount ΔRn(ω) using the following expression (7). That is, the update amount calculation section 502 obtains the highest intensity sound source direction θmax and the lowest intensity sound source direction θmin within non-scan ranges extracted by the extraction section 501 and direction vectors d(θ,ω). The update amount calculation section 502 then calculates the correlation matrix update amount ΔRn(ω) using these pieces of information in such a way as to increase intensity in the θmax direction (that is, increases the amount of cancellation) and decrease intensity in the θmin direction (that is, decreases the amount of cancellation).

$$\Delta Rn(\omega)=\alpha\cdot d^H(\theta\max,\omega)d(\theta\max,\omega)-\beta\cdot d^H(\theta\min,\omega)d(\theta\min,\omega) \quad (7)$$

In expression (7), α and β are parameters for adjusting the amount of update in the θmax and θmin directions, respectively, and $d^H$ denotes the complex conjugate transpose of d.

Update Section 503

The update section 503 estimates the second correlation matrix Rn(ω) by updating, using the correlation matrix update amount $\Delta Rn(\omega)$ calculated by the update amount calculation section 502, a correlation matrix corresponding to acoustic signals from sound sources within non-scan ranges estimated by the estimation unit 50 before the second correlation matrix $Rn(\omega)$ is estimated. The update section 503 estimates the second correlation matrix $Rn(\omega)$ by adding the correlation matrix update amount $\Delta Rn(\omega)$ calculated by the update amount calculation section 502 to the correlation matrix corresponding to the acoustic signals from the sound sources (that is, noise sources) within the non-scan ranges estimated by the estimation unit 50 before the second correlation matrix $Rn(\omega)$ is estimated.

In other word, the update section 503 updates the second correlation matrix $Rn(\omega)$ on the basis of the correlation matrix update amount $\Delta Rn(\omega)$ calculated by the update amount calculation section 502 and outputs the second correlation matrix $Rn(\omega)$. More specifically, the update section 503 updates the second correlation matrix $Rn(\omega)$ on the basis of the correlation matrix update amount $\Delta Rn(\omega)$ calculated by the update amount calculation section 502 as indicated by the following expression (8).

$$Rn(\omega)=Rn(\omega)+\Delta Rn(\omega) \quad (8)$$

The reason why the estimation unit 50 calculates the second correlation matrix $Rn(\omega)$ on the basis of the highest intensity sound source direction $\theta max$ and the lowest intensity sound source direction $\theta min$ within non-scan ranges is as follows. That is, effects of noise in a spatial spectrum (also referred to as a "heat map") output from the output unit 90 are caused because there are noise sources in directions of a peak and a dip within the non-scan ranges.

The estimation unit 50, therefore, can estimate the second correlation matrix $Rn(\omega)$ through sequential estimation based on expressions (7) and (8) by extracting the highest intensity sound source direction $\theta max$ and the lowest intensity sound source direction $\theta min$ from the spatial spectrum $P(\theta)$ within non-scan ranges.

Here, a direction vector $d(\theta, \omega)$ in a peak direction indicates a phase difference between the microphone units when amplitude is 1, and a correlation matrix corresponding to the direction vector $d(\theta, \omega)$ can be calculated by $d^H(\theta, \omega)d(\theta, \omega)$ on the basis of a relationship with expression (2).

As a result, since the estimation unit 50 estimates the second correlation matrix $Rn(\omega)$ on the basis of direction vectors, that is, theoretical values of phase information, corresponding to the highest intensity and the lowest intensity of a spatial spectrum within non-detection rages, the estimation unit 50 can estimates the second correlation matrix $Rn(\omega)$ even if there is a target sound source within a scan range.

Advantageous Effects

As described above, according to the present embodiment, effects of noise sources can be suppressed and a direction of a target sound source within a scan range can be detected even if there are noise sources within non-scan ranges whose sound pressure levels are higher than that of the target sound source. That is, according to the present embodiment, the sound source detection apparatus 100 capable of more certainly detecting a direction of a target sound source within a scan range can be achieved.

Now, advantageous effects produced by the sound source detection apparatus 100 according to the present embodiment will be described with reference to FIGS. 6 to 11.

Comparative Example

Figure 6:
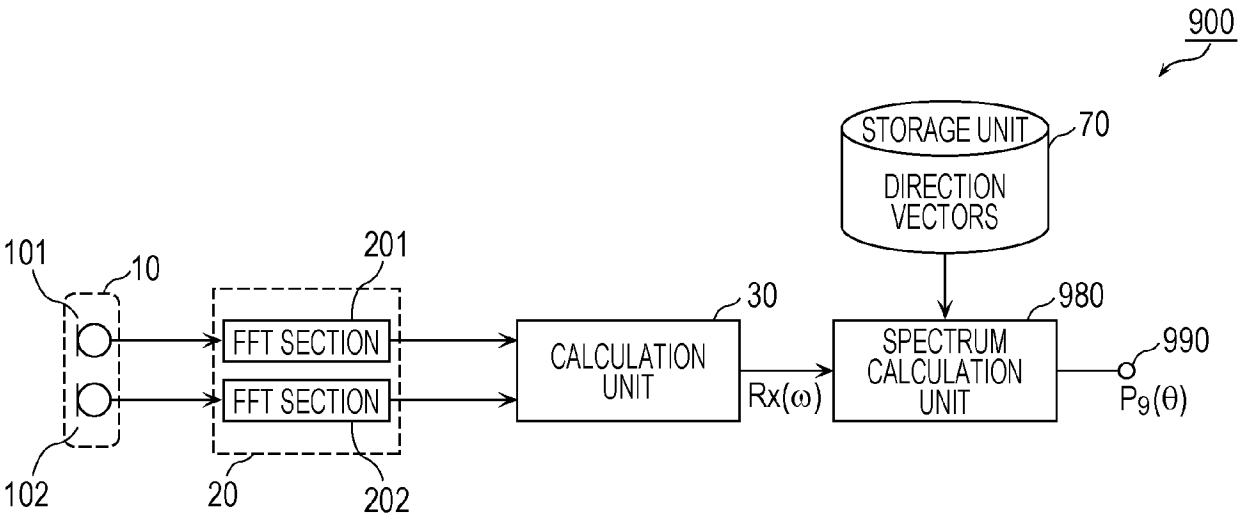
FIG. 6 is a diagram illustrating an example of the configuration of a sound source detection apparatus in a comparative example.

FIG. 6 is a diagram illustrating an example of the configuration of a sound source detection apparatus 900 in a comparative example. The same components as in FIG. 1 are given the same reference numerals, and detailed description thereof is omitted. As illustrated in FIG. 6, unlike the sound source detection apparatus 100 according to the first embodiment, the sound source detection apparatus 900 in the comparative example does not include the specification unit 40, the estimation unit 50, and the removal unit 60, and the configuration of a spectrum calculation unit 980 is different from that of the spectrum calculation unit 80. The spectrum calculation unit 980 calculates a spatial spectrum $P_9(\theta)$ on the basis of a correlation matrix (that is, the first correlation matrix), which is calculated by the calculation unit 30, between two or more acoustic signals (that is, observed signals) obtained by the microphone array 10 and direction vectors. An output unit 990 outputs this spatial spectrum $P_9(\theta)$ to an external device.

Figure 7:
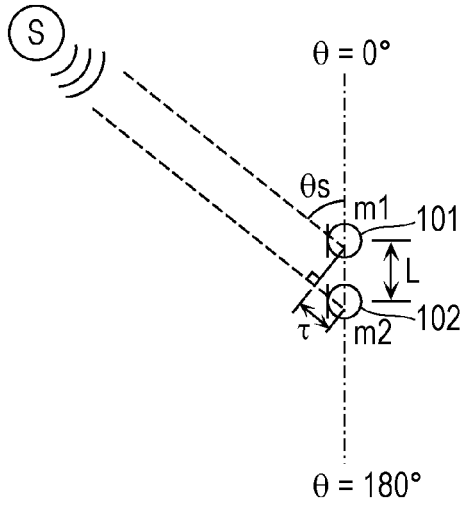
FIG. 7 is a diagram illustrating an example of a positional relationship between a target sound source and a microphone array in the comparative example.
Figure 8:
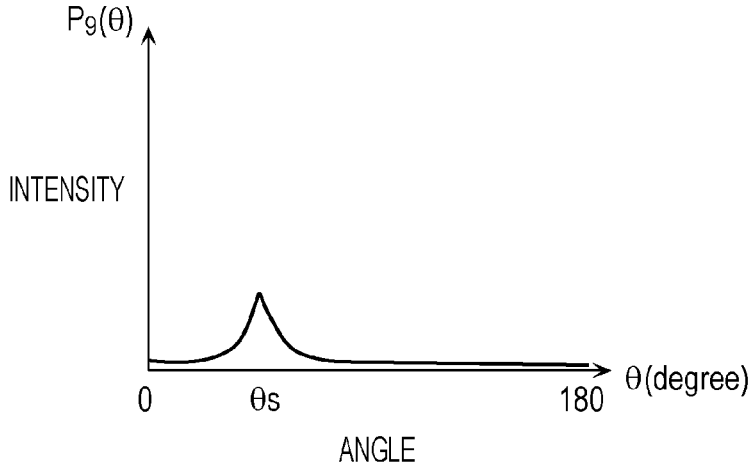
FIG. 8 is a diagram illustrating a spatial spectrum as an example of an output of a spectrum calculation unit in the comparative example in the positional relationship illustrated in FIG. 7.

FIG. 7 is a diagram illustrating an example of a positional relationship between a target sound source S and the microphone array 10 in the comparative example. The same components as in FIG. 2 are given the same reference numerals, and detailed description thereof is omitted. FIG. 8 is a diagram illustrating a spatial spectrum as an example of an output of the spectrum calculation unit 980 in the comparative example in the positional relationship illustrated in FIG. 7. In FIG. 8, a horizontal axis represents angle, and a vertical axis represents intensity.

In the example illustrated in FIG. 7, the target sound source S is located at $\theta=\theta s$ relative to the microphone unit 101, and there are no noise sources. In this case, the spatial spectrum $P_9(\theta)$, which is a localization result, calculated by the spectrum calculation unit 980 in the comparative example is as illustrated in FIG. 8. That is, an angle at which a highest intensity is observed in the spatial spectrum $P_9(\theta)$, which is the localization result, illustrated in FIG. 8, is $\theta s$. In the example illustrated in FIG. 7, therefore, the sound source detection apparatus 900 in the comparative example can estimate that the target sound source S is located at $\theta=\theta s$.

If there is noise whose sound pressure level is higher than that of sound emitted from the target sound source S, however, it is difficult for the sound source detection apparatus 900 in the comparative example to detect the target sound source S due to the noise. This case will be described hereinafter.

Figure 9:
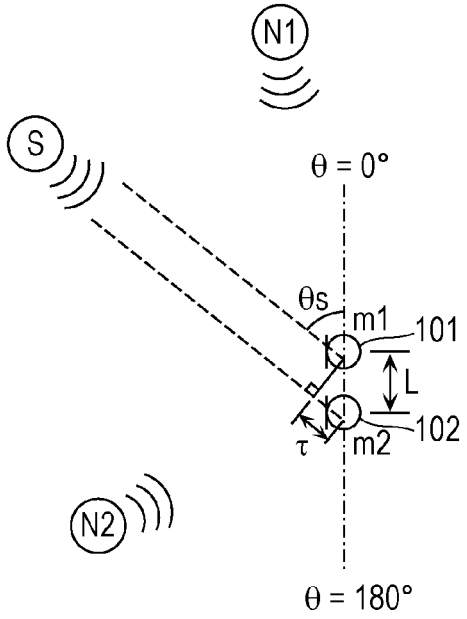
FIG. 9 is a diagram illustrating a positional relationship between the microphone array, a target sound source, and noise sources in the comparative example.
Figure 10:
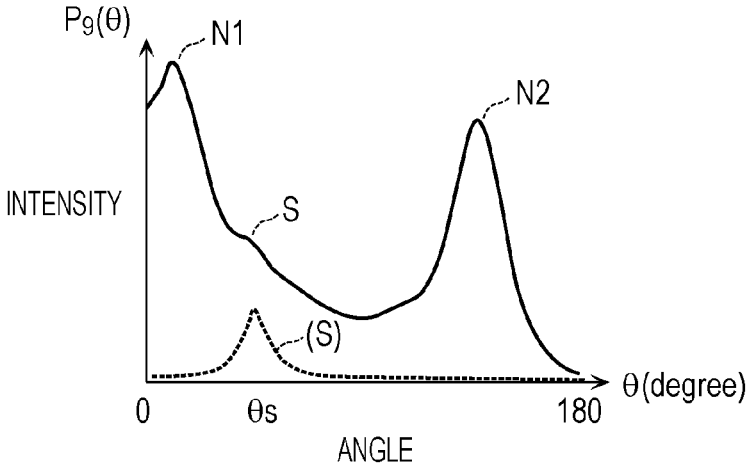
FIG. 10 is a diagram illustrating a spatial spectrum as an example of an output of the spectrum calculation unit in the comparative example in the positional relationship illustrated in FIG. 9.
Figure 11:
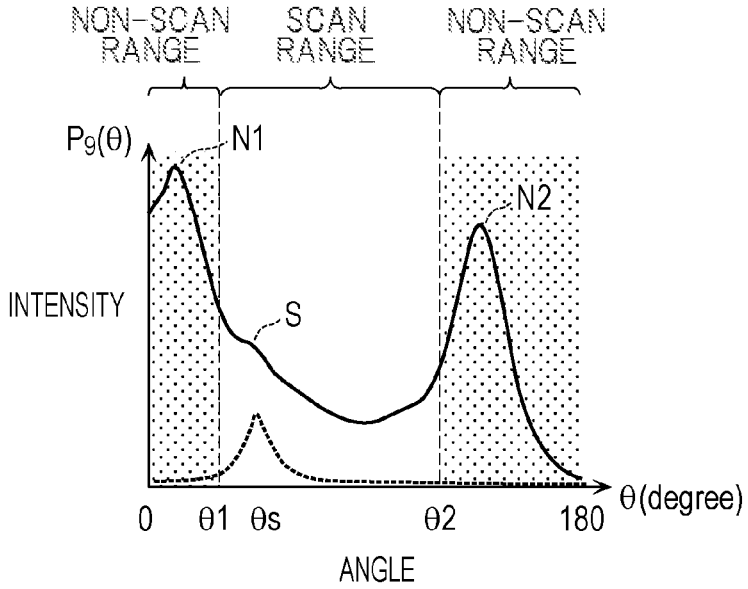
FIG. 11 is a diagram illustrating a spatial spectrum as another example of the spectrum calculation unit in the comparative example in the positional relationship illustrated in FIG. 9.

FIG. 9 is a diagram illustrating a positional relationship between the microphone array 10, the target sound source S, and noise sources N1 and N2 in the comparative example. FIG. 10 is a diagram illustrating a spatial spectrum as an example of an output of the spectrum calculation unit 980 in the comparative example in the positional relationship illustrated in FIG. 9. FIG. 11 is a diagram illustrating a spatial spectrum as another example of the output of the spectrum calculation unit 980 in the comparative example in the positional relationship illustrated in FIG. 9. The same components as in FIG. 2, 3, 7, or 8 are given the same reference numerals, and detailed description thereof is omitted.

In the example illustrated in FIG. 9, there are the noise sources N1 and N2 as well as the target sound source S. In this case, the spatial spectrum $P_9(\theta)$, which is the localization result, calculated by the spectrum calculation unit 980 in the comparative example is as illustrated in FIG. 10. That is, in the spatial spectrum $P_9(\theta)$, which is the localization result, illustrated in FIG. 10, the intensity of noise emitted from the noise source N1 appears not only in a direction of the noise source N1 but elsewhere, although the intensity decreases as an angle at which the noise is detected becomes further from the noise source N1. The same holds for the intensity of noise emitted from the noise source N2. As illustrated in FIG. 10, therefore, if the sound pressure levels of the noise sources N1 and N2 are higher than that of the target sound source S, the target sound source S is buried under peaks of the intensity of the two noise sources (noise sources N1 and N2). Because the sound source detection apparatus 900 in the comparative example does not detect the target sound source S (its peak of intensity), a direction of the target sound source S is undesirably not detected.

This problem is not solved even if the sound source detection apparatus 900 in the comparative example excludes direction ranges within which the noise sources N1 and N2 exist from a scan range as non-scan ranges as illustrated in FIG. 11. That is, even if the sound source detection apparatus 900 excludes the direction ranges within which the noise sources N1 and N2 exist from the scan range, the peak of the intensity of sound emitted from the target sound source S is still affected by the noise sources N1 and N2 and buried as indicated by a solid curve indicated in a graph of FIG. 11. It is therefore difficult for the sound source detection apparatus 900 in the comparative example to detect the target sound source S (that is, its peak of intensity) and the direction of the target sound source S.

Advantageous Effects Produced by First Embodiment

The sound source detection apparatus 100 according to the present embodiment limits, by specifying non-scan ranges as in FIG. 2, the detection of the direction of the target sound source S to a range (the scan range θ1 to θ2 in FIG. 2) within which a final localization result is to be obtained. The sound source detection apparatus 100 according to the present embodiment then removes noise components by subtracting a correlation matrix (that is, the second correlation matrix) corresponding to sound sources (that is, noise sources) within the non-scan ranges from a correlation matrix (that is, the first correlation matrix) corresponding to observed signals. This is because, as described above, the correlation matrix (that is, the first correlation matrix) obtained from observed signals obtained by the microphone array 10 is a correlation matrix including components corresponding to sound sources in all directions from the microphone array 10.

The sound source detection apparatus 100 according to the present embodiment can thus obtain the third correlation matrix corresponding only to a sound source within a scan range, that is, a target sound source, by removing the second correlation matrix within non-scan ranges from the first correlation matrix calculated from observed signals of sound waves coming from all directions. As a result, the sound source detection apparatus 100 can output the spatial spectrum P(θ) illustrated in FIG. 3 as a localization result. Since the angle at which the highest intensity is observed is θs in FIG. 3, the direction of the target sound source S can be estimated as θ=θs.

It is to be noted that, in order to remove effects of noise coming from non-scan ranges, it is important to estimate a correlation matrix (that is, the second correlation matrix) corresponding only to noise sources within the non-scan ranges. This is because if the target sound source S leaks into the estimated second correlation matrix within the non-scan ranges, a result of the estimation is likely to be incorrect. In an actual environment, there are sound sources within non-scan ranges, that is, noise sources, as well as the target sound source S within a scan range. It is therefore difficult for the sound source detection apparatus 900 in the comparative example to estimate the correlation matrix (that is, the second correlation matrix) corresponding only to the sound sources within the non-scan ranges, that is, the noise sources.

On the other hand, the sound source detection apparatus 100 according to the present embodiment obtains the second correlation matrix corresponding to sound sources certainly located within non-scan ranges, that is, noise sources, while focusing upon a fact that a difference between sound sources within a scan range and the non-scan ranges is directions. In other words, the sound source detection apparatus 100 calculates the second correlation matrix from direction vectors (that is, theoretical values of phase information) corresponding to the non-scan ranges and a localization result (that is, observed values of intensity). Since, as described above, the phase information is calculated from theoretical values, the sound source detection apparatus 100 can estimate the second correlation matrix that corresponds to the sound sources within the non-scan ranges and that does not affect the scan range at least in detection of directions even if there is an error in amplitude information (that is, intensity).

As described above, even when there are noise sources within non-scan ranges whose sound pressure levels are higher than that of a target sound source, the sound source detection apparatus 100 according to the present embodiment can detect a direction of the target sound source within a scan range while suppressing effects of the noise sources. As a result, sound source detection performance, that is, noise tolerance performance, in a noisy environment improves. This is because the second correlation matrix can be accurately estimated and the noise tolerance performance in the estimation of a direction of a sound source within the scan range improves by estimating a correlation matrix (that is, the second correlation matrix) corresponding to the non-scan ranges from direction vectors corresponding to the non-scan ranges, that is, theoretical values, and a localization result within the non-scan ranges, that is, a spatial spectrum.

In an ordinary environment in which there are no such noise sources, the sound source detection apparatus 100 according to the present embodiment can detect a sound source within a scan range whose sound pressure level is low.

First Modification

Figure 12:
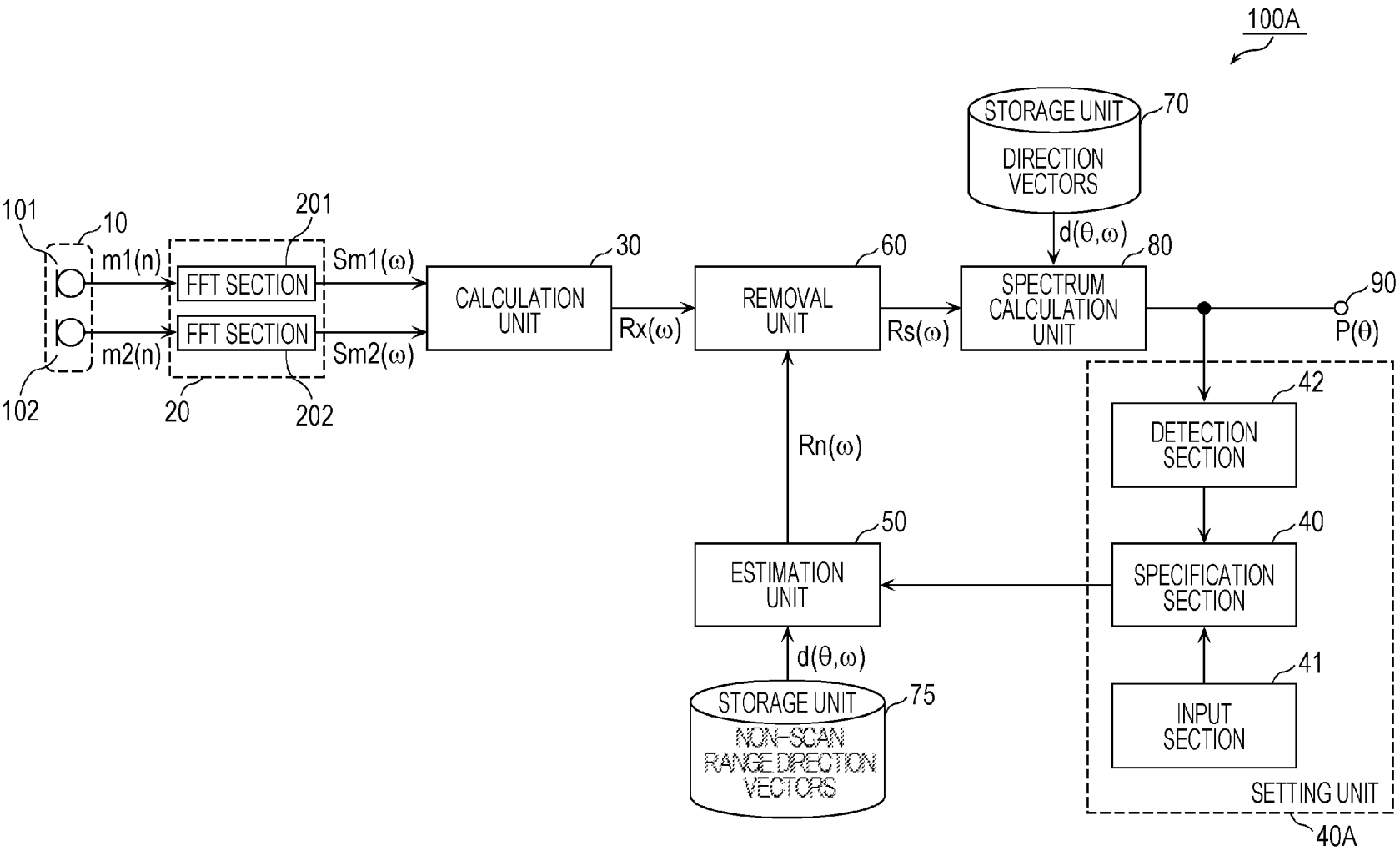
FIG. 12 is a diagram illustrating an example of the configuration of a sound source detection apparatus according to a first modification.

FIG. 12 is a diagram illustrating an example of the configuration of a sound source detection apparatus 100A according to a first modification. The same components as in FIG. 1 are given the same reference numerals, and detailed description thereof is omitted.

The sound source detection apparatus 100A illustrated in FIG. 12 is different from the sound source detection apparatus 100 according to the first embodiment in that the sound source detection apparatus 100A includes a setting unit 40A.

The setting unit 40A includes a specification section 40, an input section 41, and a detection section 42. The input section 41 and the detection section 42 are not mandatory components. It is sufficient that the setting unit 40A includes at least either the input section 41 or the detection section 42 and the specification section 40.

The input section 41 enables a user to add or remove a non-scan range to or from the specification section 40. More specifically, the input section 41 is a user interface of the specification section 40 and enables the user to specify or change a non-scan range before or during the operation of the sound source detection apparatus 100A. When both the input section 41 and the detection section 42 are provided, the input section 41 may specify a candidate for a non-scan range output from the detection section 42 or change a specified non-scan range to the candidate.

The detection section 42 detects a direction in which a noise source, which is a sound source that interferes with detection of a direction of a target sound source, exists from the second spatial spectrum calculated by the spectrum calculation unit 80 as a candidate for a non-scan range.

Here, when the input section 41 is not provided, the detection section 42 may update a non-scan range specified by the specification section 40 to the candidate for a non-scan range. More specifically, if noise continues to be detected in the spatial spectrum P(θ), the detection section 42 may detect a non-scan range, that is, a direction in which a noise source exists, and cause the specification section 40 to specify the detected direction, that is, the detected non-scan range.

As a method for detecting a candidate for a non-scan range, a method may be used in which a range within which a sound pressure level remains high in a spatial spectrum output for a certain period of time, which is a result of detection of a sound source for the certain period of time, is detected as a candidate for a non-scan range. Alternatively, a method may be used in which a candidate for a non-scan range is detected by determining a type of sound of acoustic signals from the microphone array 10 through sound recognition. More specifically, a method may be used in which, if it is determined that a type of sound of a sound source whose direction has been detected is different from a type of sound of a target sound source, and if it is determined that the sound source exists in a certain direction, the certain direction is detected as a non-detection direction.

Second Modification

Figure 13:
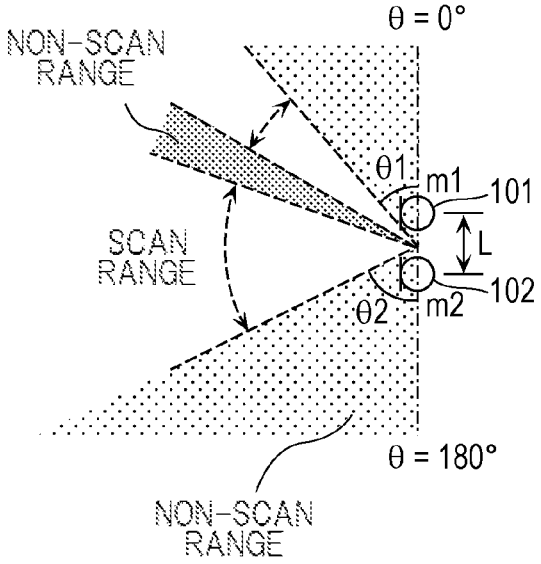
FIG. 13 is a diagram illustrating scan ranges and non-scan ranges according to a second modification.

FIG. 13 is a diagram illustrating scan ranges and non-scan ranges according to a second modification. The same components as in FIG. 2 are given the same reference numerals, and detailed description thereof is omitted.

Although the specification unit (specification section) 40 specifies two non-scan ranges, namely ranges of 0° to θ1 and θ2 to 180°, in the first embodiment and the first modification, the non-scan ranges specified by the specification section 40 are not limited to these. The specification section 40 may specify three or more ranges as illustrated in FIG. 13, instead.

Third Modification

Figure 14:
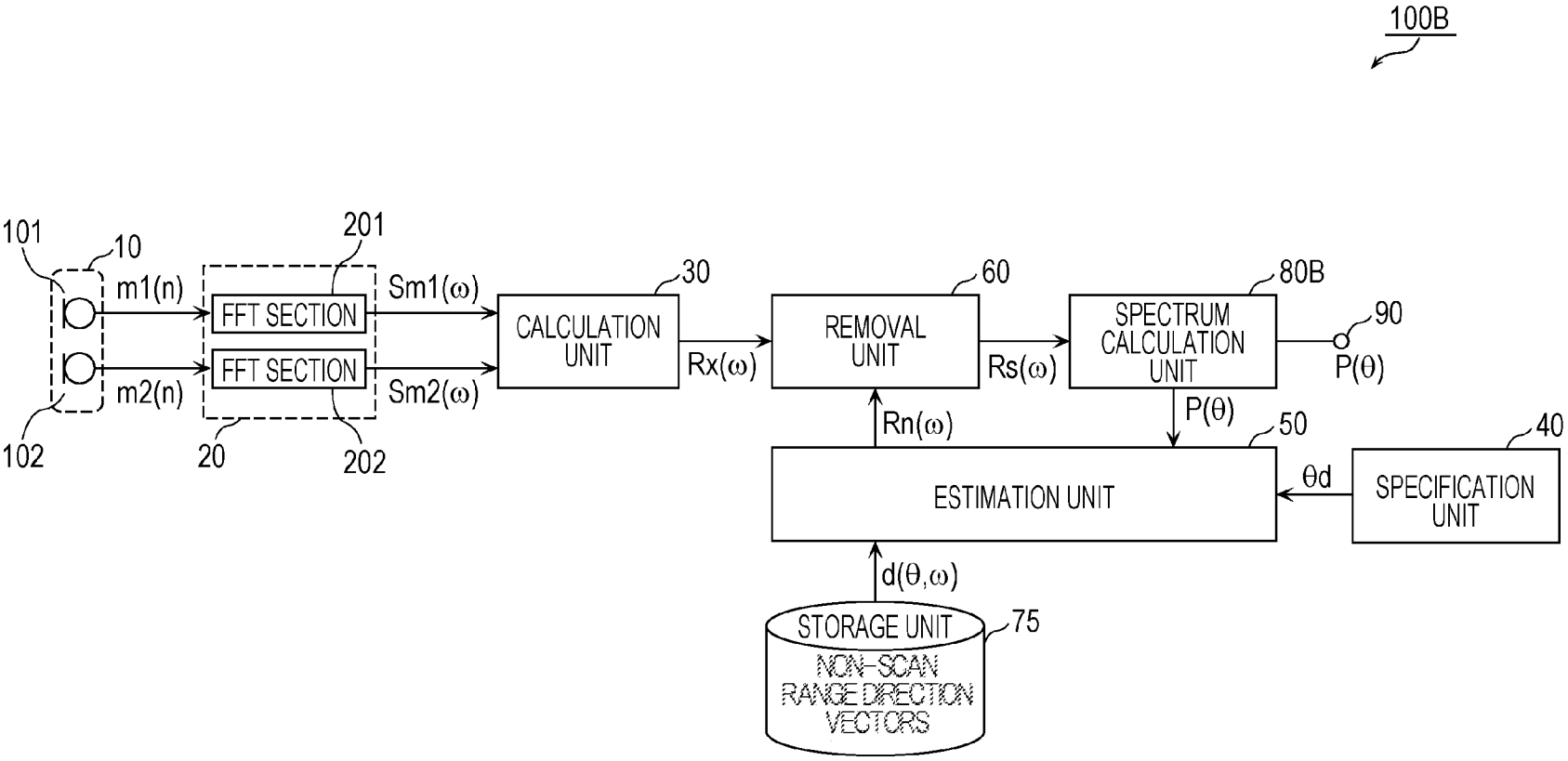
FIG. 14 is a diagram illustrating an example of the configuration of a sound source detection apparatus according to a third modification.

FIG. 14 is a diagram illustrating an example of the configuration of a sound source detection apparatus 100B according to a third modification. The same components as in FIG. 1 are given the same reference numerals, and detailed description thereof is omitted.

Unlike the sound source detection apparatus 100 according to the first embodiment, the sound source detection apparatus 100B illustrated in FIG. 14 does not include the storage unit 70, and the configuration of a spectrum calculation unit 80B is different from that of the spectrum calculation unit 80.

Unlike the spectrum calculation unit 80 according to the first embodiment, the spectrum calculation unit 80B calculates the first spatial spectrum without using direction vectors. The spectrum calculation unit 80B can calculate the first spatial spectrum by performing, for example, eigenvalue expansion of the third correlation matrix Rs(ω).

Second Embodiment

Although a case in which the second correlation matrix Rn(ω) is estimated using direction vectors of non-scan ranges stored in the storage unit 75 and the second spatial spectrum calculated by the spectrum calculation unit 80 has been described in the first embodiment, a method for estimating the second correlation matrix Rn(ω) is not limited to this. The second correlation matrix Rn(ω) can be estimated without using direction vectors of non-scan ranges, which will be described hereinafter as a second embodiment.

Configuration of Sound Source Detection Apparatus 200

Figure 15:
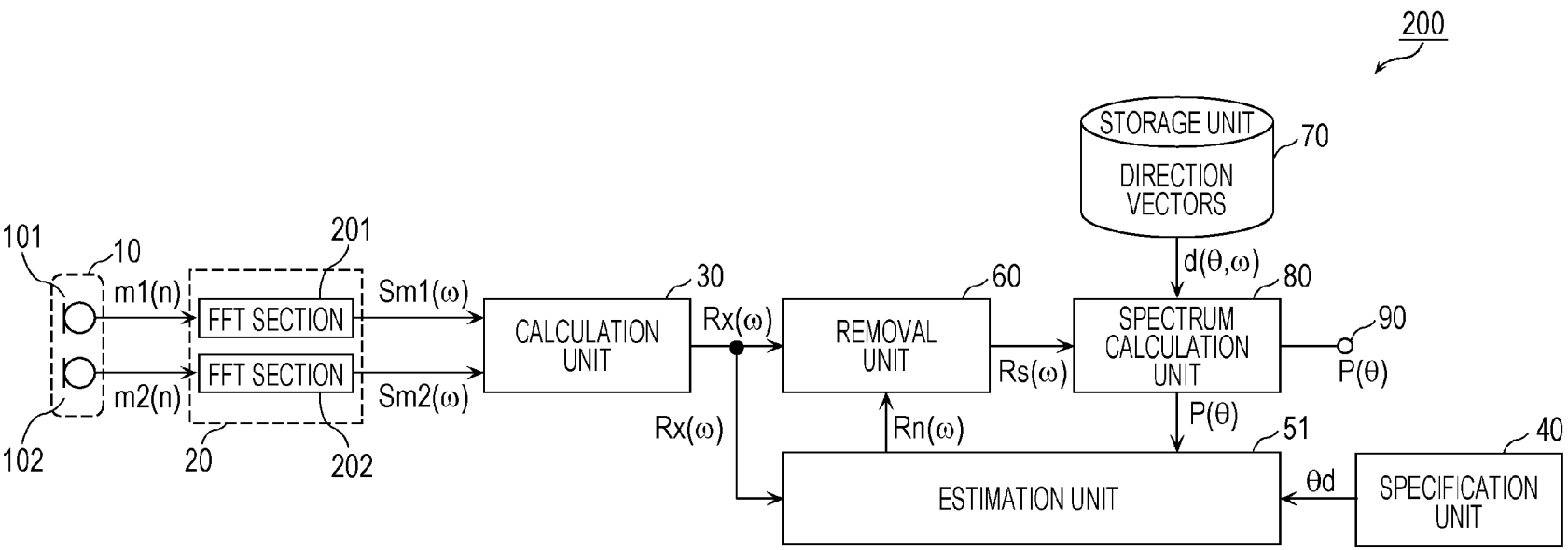
FIG. 15 is a diagram illustrating an example of the configuration of a sound source detection apparatus according to a second embodiment.

FIG. 15 is a diagram illustrating an example of the configuration of a sound source detection apparatus 200 according to the second embodiment. The same components as in FIG. 1 are given the same reference numerals, and detailed description thereof is omitted.

Unlike the sound source detection apparatus 100 according to the first embodiment, the sound source detection apparatus 200 illustrated in FIG. 15 does not include the storage unit 75, and the configuration of an estimation unit 51 is different from that of the estimation unit 50.

Estimation Unit 51

The estimation unit 51 estimates the second correlation matrix Rn(ω) corresponding only to sound sources within non-scan ranges, that is, noise sources. More specifically, the estimation unit 51 estimates the second correlation matrix Rn(ω), which corresponds to acoustic signals from sound sources within the non-scan ranges (that is, the noise sources) specified by the specification section 40, using the first correlation matrix Rx(ω) at a time when spatial spectrum intensities corresponding to the acoustic signals from the sound sources within the non-scan ranges are higher than a threshold and there is no acoustic signal from a target sound source within a scan range, which is a direction range the sound source detection apparatus 200 is to perform detection.

In the present embodiment, the estimation unit 51 outputs the second correlation matrix Rn(ω) on the basis of angular ranges θd, which are non-scan ranges specified by the specification section 40, the second spatial spectrum P(θ) calculated by the spectrum calculation unit 80, and the first correlation matrix Rx(ω) calculated by the calculation unit 30.

Here, as in the first embodiment, the second correlation matrix Rn(ω) is used for removing effects of noise coming from the non-scan ranges. The estimation unit 51, therefore, needs to estimate a correlation matrix corresponding only to sound waves coming from directions indicated by the angular ranges θd, which are the non-scan ranges. That is, the second correlation matrix Rn(ω) desirably does not include a component of sound waves coming from the scan range. The estimation unit 51 therefore needs to detect that intensity within the non-scan ranges is sufficiently high in the second spatial spectrum and a level (that is, a sound pressure level) of a sound wave component within the non-scan ranges is sufficiently higher than a level (that is, a sound pressure level) of a sound wave component within the scan range. The estimation unit 51 may then estimate the second correlation matrix Rn(ω) by temporally averaging the first correlation matrix Rx(ω) at a time when the level (that is, the sound pressure level) of the sound wave component within the non-scan ranges is sufficiently higher than the level (that is, the sound pressure level) of the sound wave component within the scan range.

A determination whether the intensity within the non-scan ranges is sufficiently high in the second spatial spectrum can be made as a threshold determination. The determination may be made using the following expression (9), for example, while denoting, in a spatial spectrum P(θ) at a certain point in time, the sum of all directions (0°≤θ≤180°) as $\Sigma_\theta P(\theta)$, the sum of the non-scan ranges as $\Sigma_{\theta d} P(\theta d)$, and a threshold used for the determination as Th.

$$Th \times \Sigma_\theta P(\theta) < \Sigma_{\theta d} P(\theta d) \quad (9)$$

When the sum of intensities within the scan range and the sum of intensities within the non-scan ranges are the same in the spatial spectrum P(θ), a threshold level is Th=0.5. In order to identify a state in which the intensity within the non-scan ranges is higher than the intensity within the scan range in the spatial spectrum, a range of Th is approximately $0.5 \leq Th \leq 1$. In order to identify a state in which the intensity within the non-scan ranges is sufficiently high in the spatial spectrum, Th of 0.9 or larger may be used. It is to be noted that Th needs to be adjusted in accordance with a sound pressure level of a target sound source and a surrounding noise environment.

The estimation unit 51 then estimates the second correlation matrix Rn(ω) by temporally averaging the first correlation matrix Rx(ω) that satisfies the above threshold determination, for example, using the following expression (10).

$$Rn(\omega)_{(t)}=C_A \cdot Rn(\omega)_{(t-1)}+C_B \cdot Rx(\omega)_{(t)} \quad (10)$$

Here, $C_A$ and $C_B$ are smoothing coefficients and satisfy $C_A+C_B=1$. A subscript (t) denotes present time, and a subscript (t−1) denotes a value before update.

Advantageous Effects

As described above, according to the present embodiment, even if there are noise sources within non-scan ranges whose sound pressure levels are higher than that of a target sound source, a direction of the target sound source within a scan range can be detected while suppressing effects of the noise sources. That is, according to the present embodiment, the sound source detection apparatus 200 capable of more certainly detecting a direction of a target sound source within a scan range can be achieved.

In the present embodiment, a determination is made using the third correlation matrix Rs(ω) in the past, which corresponds to a target sound source within a scan range calculated by the removal unit 60, that is, the second spatial spectrum P(θ) corresponding to estimated values. The estimation unit 51, therefore, updates the second correlation matrix Rn(ω) if remaining intensity obtained after a non-scan range component is removed is high.

Alternatively, the estimation unit 51 may calculate the spatial spectrum P(θ) corresponding to the first correlation matrix Rx(ω) using the first correlation matrix Rx(ω) calculated by the calculation unit 30 and use the spatial spectrum P(θ) for the determination.

Although the sound source detection apparatus and the like according to one or a plurality of aspects of the present disclosure have been described above on the basis of the embodiments and the modifications, the present disclosure is not limited to these embodiments and the like. The one or plurality of aspects of the present disclosure may also include modes obtained by modifying the embodiments in various ways conceivable by those skilled in the art and modes obtained by combining components in different embodiments without deviating from the spirit of the present disclosure. The following cases, for example, are included in the present disclosure.

(1) The sound source detection apparatus may further include, for example, image capture means, such as a camera, and a signal processing unit for processing a captured image. In this case, in the sound source detection apparatus, the camera may be arranged at the center of the microphone array or outside the microphone array.

More specifically, an image captured by the camera may be input to the signal processing unit, and an image obtained by superimposing a sound source image subjected to processing performed by the signal processing unit and indicating a position of a target sound source upon the input image may be displayed on a display unit connected to the sound source detection apparatus as a result of processing.

(2) The sound source detection apparatus may specifically be a computer system including a microprocessor, a read-only memory (ROM), a random-access memory (RAM), a hard disk unit, a display unit, a keyboard, and a mouse. The RAM or the hard disk unit stores a computer program. When the microprocessor operates in accordance with the computer program, the components achieve functions thereof. Here, the computer program is obtained by combining a plurality of command codes indicating instructions to a computer in order to achieve certain functions.

(3) Some or all of the components of the sound source detection apparatus may be achieved by a single system large-scale integration (LSI) circuit. The system LSI circuit is a super-multifunction LSI circuit fabricated by integrating a plurality of components on a single chip and is specifically a computer system including a microprocessor, a ROM, and a RAM. The RAM stores a computer program. When the microprocessor operates in accordance with the computer program, the system LSI circuit achieves functions thereof.

(4) Some or all of the components of the sound source detection apparatus may be achieved by an integrated circuit (IC) card or a separate module removably attached to a device. The IC card or the module is a computer system including a microprocessor, a ROM, and a RAM. The IC card or the module may also include the super-multifunction LSI circuit. When the microprocessor operates in accordance with a computer program, the IC card or the module achieves functions thereof. The IC card or the module may be tamper-resistant.

The present disclosure can be used for a sound source detection apparatus including a plurality of microphone units and can particularly be used for a sound source detection apparatus capable of more certainly detecting a direction of a sound source, such as a radio-controlled helicopter or a drone located far from the sound source detection apparatus, whose sounds are smaller than other environmental sounds at the microphone units.

What is claimed is:

1. An apparatus, comprising:

one or more memories; and circuitry that, in operation, performs operations, including:

calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result, wherein, in the estimating, the second correlation matrix is estimated on the basis of direction vectors obtained from the direction range of the non-scan range and a second spatial spectrum, which is a localization result immediately before the first spatial spectrum is calculated.

2. The apparatus according to claim 1, wherein the estimating includes:

extracting angle information, which indicates a lowest intensity direction and a highest intensity direction of the second spatial spectrum within the non-scan range on the basis of the direction range of the non-scan range and the second spatial spectrum, calculating, as a correlation matrix update amount, a correlation matrix corresponding to the second spatial spectrum in the lowest intensity direction and the highest intensity direction on the basis of the angle information and the direction vectors, and updating a fourth correlation matrix using the correlation matrix update amount to estimate the second correlation matrix, the fourth correlation matrix being a correlation matrix that is estimated before the second correlation matrix is estimated and that corresponds to an acoustic signal from a sound source within the non-scan range.

3. The apparatus according to claim 2, wherein, in the updating, the second correlation matrix is estimated by adding the correlation matrix update amount to the fourth correlation matrix.

4. The apparatus according to claim 1, wherein, in the calculating the first spatial spectrum, the first spatial spectrum is calculated on the basis of the third correlation matrix and the direction vectors.

5. An apparatus, comprising:

circuitry that, in operation, performs operations, including:

calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, using the first correlation matrix at a time when a spatial spectrum intensity corresponding to the acoustic signal from the sound source within the non-scan range is higher than a threshold and there is no acoustic signal from the target sound source within a scan range, which indicates a direction range within which the target sound source is to be detected, calculating a third correlation matrix, which corresponds to the target sound source within the scan range, by removing the second correlation matrix from the first correlation matrix, and calculating a first spatial spectrum on the basis of the third correlation matrix as a localization result.

6. The apparatus according to claim 1, wherein the operations further include:

detecting a direction in which a noise source, which is a sound source that interferes with detection of a direction of the target sound source, exists in the second spatial spectrum as a candidate for the non-scan range.

7. The apparatus according to claim 1, wherein, in the specifying, a user adds or removes a non-scan range.

8. The apparatus according to claim 1, wherein the operations further include:

outputting frequency spectrum signals, which are obtained by transforming the acoustic signals obtained by the two or more microphone units into frequency domain signals, and calculating, in the calculating the first correlation matrix, the first correlation matrix on the basis of the frequency spectrum signals.

9. A method comprising:

calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result, wherein, in the estimating, the second correlation matrix is estimated on the basis of direction vectors obtained from the direction range of the non-scan range and a second spatial spectrum, which is a localization result immediately before the first spatial spectrum is calculated.

10. A non-transitory computer-readable recording medium storing a program, that, when executed by a computer, causes the computer to implement a method comprising:

calculating a first correlation matrix, which corresponds to observed signals, which are acoustic signals obtained by a microphone array including two or more separately arranged microphones, specifying a non-scan range, which indicates a direction range within which a target sound source is not to be detected, estimating a second correlation matrix, which corresponds to an acoustic signal from a sound source within the non-scan range, calculating a third correlation matrix, which corresponds to the target sound source within a scan range, which indicates a direction range within which the target sound source is to be detected, by removing the second correlation matrix from the first correlation matrix, and calculating a first spatial spectrum on the basis of the third correlation matrix as a localization result, wherein, in the estimating, the second correlation matrix is estimated on the basis of direction vectors obtained from the direction range of the non-scan range and a second spatial spectrum, which is a localization result immediately before the first spatial spectrum is calculated.

* * * * *